US007706506B1

(12) United States Patent
Woodruff et al.

(10) Patent No.: US 7,706,506 B1
(45) Date of Patent: Apr. 27, 2010

(54) X-RAY SYSTEM FOR IRRADIATING MATERIAL USED IN TRANSFUSIONS

(75) Inventors: Ralph R. Woodruff, Thornton, CO (US); Stoyan A. Toshkov, Champaign, IL (US); Todor I. Donchev, Urbana, IL (US)

(73) Assignee: Applied X-Rad Technology, LLC, Thornton, CO (US)

( * ) Notice: Subject to any disclaimer, the term of this patent is extended or adjusted under 35 U.S.C. 154(b) by 0 days.

(21) Appl. No.: 12/316,503

(22) Filed: Dec. 12, 2008

Related U.S. Application Data

(60) Provisional application No. 61/013,939, filed on Dec. 14, 2007.

(51) Int. Cl.
*H01J 35/00* (2006.01)

(52) U.S. Cl. ..... 378/121; 378/66

(58) Field of Classification Search ..... 378/64–69, 378/119, 121, 140, 156–159
See application file for complete search history.

(56) References Cited

U.S. PATENT DOCUMENTS 4,887,604 A * 12/1989 Shefer et al. ..... 600/431
6,212,255 B1 * 4/2001 Kirk ..... 378/66
6,614,876 B1 * 9/2003 Kirk ..... 378/64

* cited by examiner

*Primary Examiner*—Courtney Thomas
(74) *Attorney, Agent, or Firm*—Edwin H. Crabtree; Ramon L. Pizarro

(57) ABSTRACT

A system for irradiating material used in transfusions. The material can be pre-transfused blood, blood components and marrow. The system includes a vacuum chamber with a plate cathode inside. The cathode has a large beam electrode field-electron emissive surface with a selected cross-sectional shaped area. A power supply is connected to the cathode for generating negative high-voltage pulses and causing a selected cross-sectional shaped beam of electrons to be emitted. An electron window is also disposed inside the vacuum chamber and made of thin metal foil. The electron window receives the selected cross-sectional shaped beam of electrons therethrough and onto an electron target disposed outside the vacuum chamber. The electron target receives the selected cross-sectional shaped beam of electrons thereon and generates a selected cross-sectional shaped X-ray beam. A cathode filter is disposed next to the electron target and eliminates low energy beams from the spectrum of the X-ray beam. The filtered X-ray beam exposes the material to high energy beams for irradiation.

20 Claims, 7 Drawing Sheets

X-RAY SYSTEM FOR IRRADIATING MATERIAL USED IN TRANSFUSIONS

This non-provisional patent application claims the benefit of an earlier filed provisional patent application Ser. No. 61/013,939, by the subject inventors, and filed on Dec. 14, 2007.

BACKGROUND OF THE INVENTION

In transfusion and transplant medicine, the transfusion of blood or blood components sometimes results in TA-GVHD (Transfusion Associated-Graft-Versus-Host Disease). Although rare, TA-GVHD results in a mortality rate of greater than 90% of cases, when this complication occurs. At this time there is no known, effective treatment for TA-GVHD. Without available treatment, the only method of dealing with TA-GVHD is prevention. Today, the only accepted method of prevention for TA-GVHD is in the FDA prescribed dose of ionizing radiation, provided by either gamma emitting radioactive sources or by X-ray sources, applied to pre-transfused, blood and blood components in transfusion medicine. However, cost and size of commercially available X-ray source irradiation equipment prevents deployment at all transfusion facilities and other locations where blood transfusions occur.

SUMMARY OF THE INVENTION\

A primary object of the subject X-ray irradiation system described herein is for the irradiation of pre-transfused blood, blood components and marrow transplants in transfusion medicine.

Another key object of the invention is to provide a system with a greater uniformity of both the X-ray energy and it's intensity across the field of radiation and to reduce the necessity for large distances between the X-ray source and the material being irradiated. By reducing this distance, less shielding is required as the object/material being irradiated may be positioned close to the X-ray source, thereby reducing the volume that requires radiation shielding. Through "transmission geometry," greater efficiency (nearly twice that obtained in "reflection geometry") is achieved in converting electron beam energy into X-ray radiation.

Still another object of the X-ray irradiation system can be used in irradiation applications in life science research. Also, the X-ray source radiation technology may be used in other irradiation applications.

These and other objects of the present invention will become apparent to those familiar with X-ray blood irradiation systems and equipment when reviewing the following detailed description, showing novel construction, combination, and elements as herein described, and more particularly defined by the claims, it being understood that changes in the embodiments to the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments in the present invention according to the best modes presently devised for the practical application of the principles thereof, and in which.

DETAILED DESCRIPTION OF THE PREFERRED EMBODIMENTS

Figure 1:
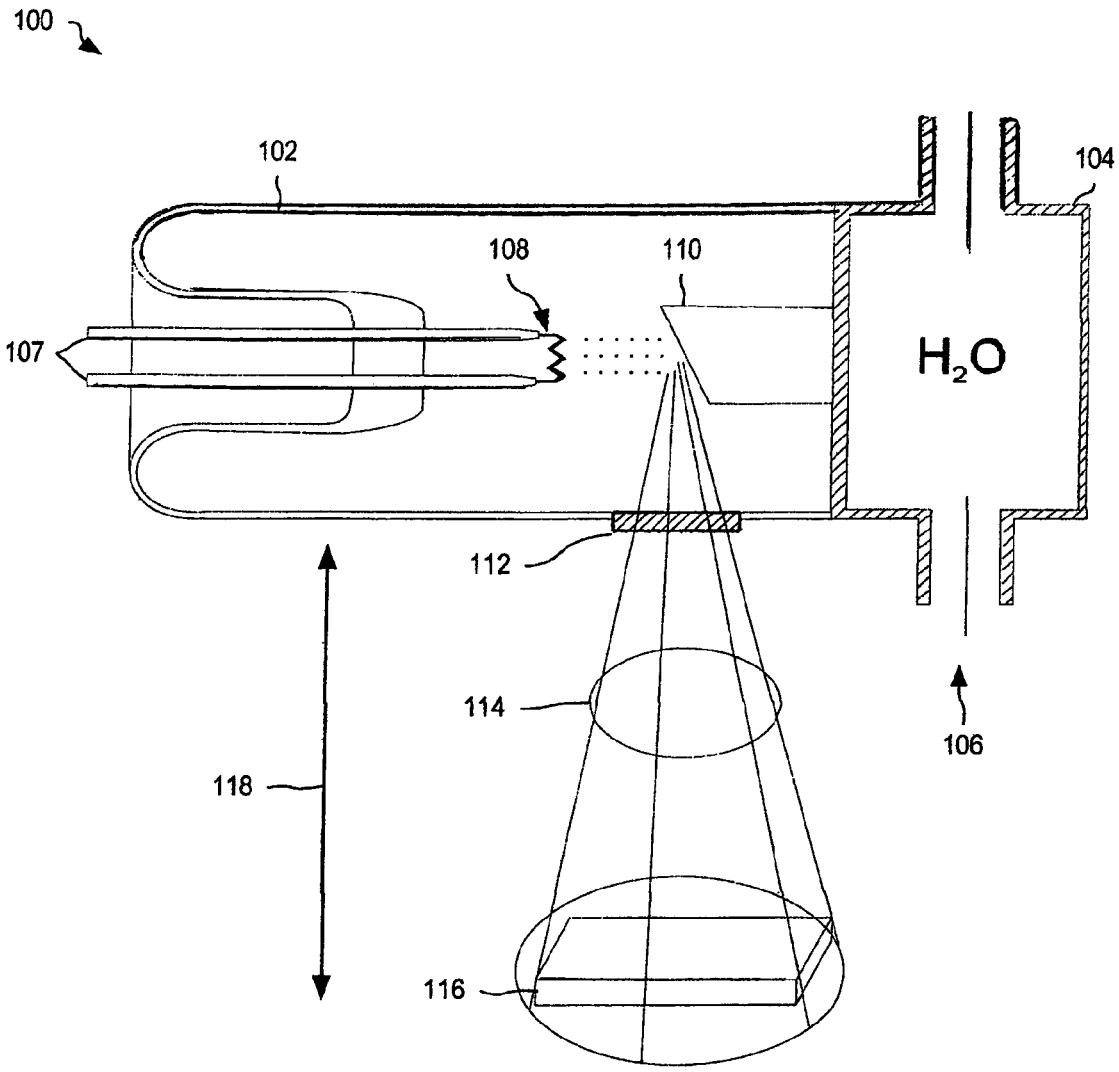
FIG. 1 PRIOR ART
FIG. 1 shows one prior art thermal electron emission reflective geometry X-ray source.

For the blood transfusion market, commercially available X-ray source blood irradiation equipment is based upon technology such as prior-art industrial, "reflective geometry" continuous emission X-ray source 100, shown in FIG. 1. X-ray source 100 consists of an evacuated enclosure 102 with a thermionic electron emission cathode filament 108, a reflective anode target 110, an X-ray window 112 and a cooling chamber 104.

Low voltage power is supplied to thermionic electron emission cathode filament 108 via electrodes 107. Current flowing through cathode filament 108, heats cathode filament 108, resulting in thermionic emission of electrons. High voltage applied between cathode filament 108 and reflective anode target 110 creates a high magnitude electric field between these two components of X-ray source 100. Thermally emitted electrons from cathode filament 108 are accelerated by the high magnitude electric field toward reflective anode 110. These electrons are focused on a small target area of anode 110 and impact anode 110, resulting in X-ray production. A small originating point source, conical shaped X-ray beam 114 is emitted from anode 110, and exits evacuated enclosure 102 through X-ray window 112. The electrons impacting the small target area of anode 110 generate heat and require that a coolant 106 be passed through cooling chamber 104 in order to cool X-ray source 100.

The required constant potential high voltage power supply is complex in design, large in size (since it typically uses large, heavy transformers) and is expensive to produce.

Disadvantages of X-ray source 100 include: a) low efficiency in converting electron energy to X-ray energy in the target of anode 110; and b) the conical shaped X-ray beam 114 emanating from anode 110. A cross-section of X-ray beam 114 approximates a circle, the diameter of which is dependent upon a distance 118 from X-ray source 100. For example, in one commercially available blood irradiation system, the distance 118 from X-ray source 100 to a material/object 116 for irradiation (e.g., a blood container) is approximately 23 cm (9 inches). This distance 118 is required in order to provide an irradiation field large enough to cover the dimensions of a typical blood container (e.g., a blood bag). In this example prior art system, X-ray beam 114 at a distance of 23 cm from X-ray source 100 is approximately 15.5 cm (6 inches) in diameter. This example irradiation system uses two opposing X-ray sources 100 with a distance of approximately 50 cm (20 inches) between the two sources, resulting in the need to shield a large volume that includes two X-ray sources 100, the space between the sources and the sample container, with lead shielding to prevent X-ray radiation external to this volume. The inverse square law dependence of irradiation intensity with the distance of the material being irradiated from X-ray source 100 results in greater non-uniformity in the radiation received by the material/object 116 being irradiated, and a longer time period is required to reach a required total absorbed irradiation dosage.

Figure 2:
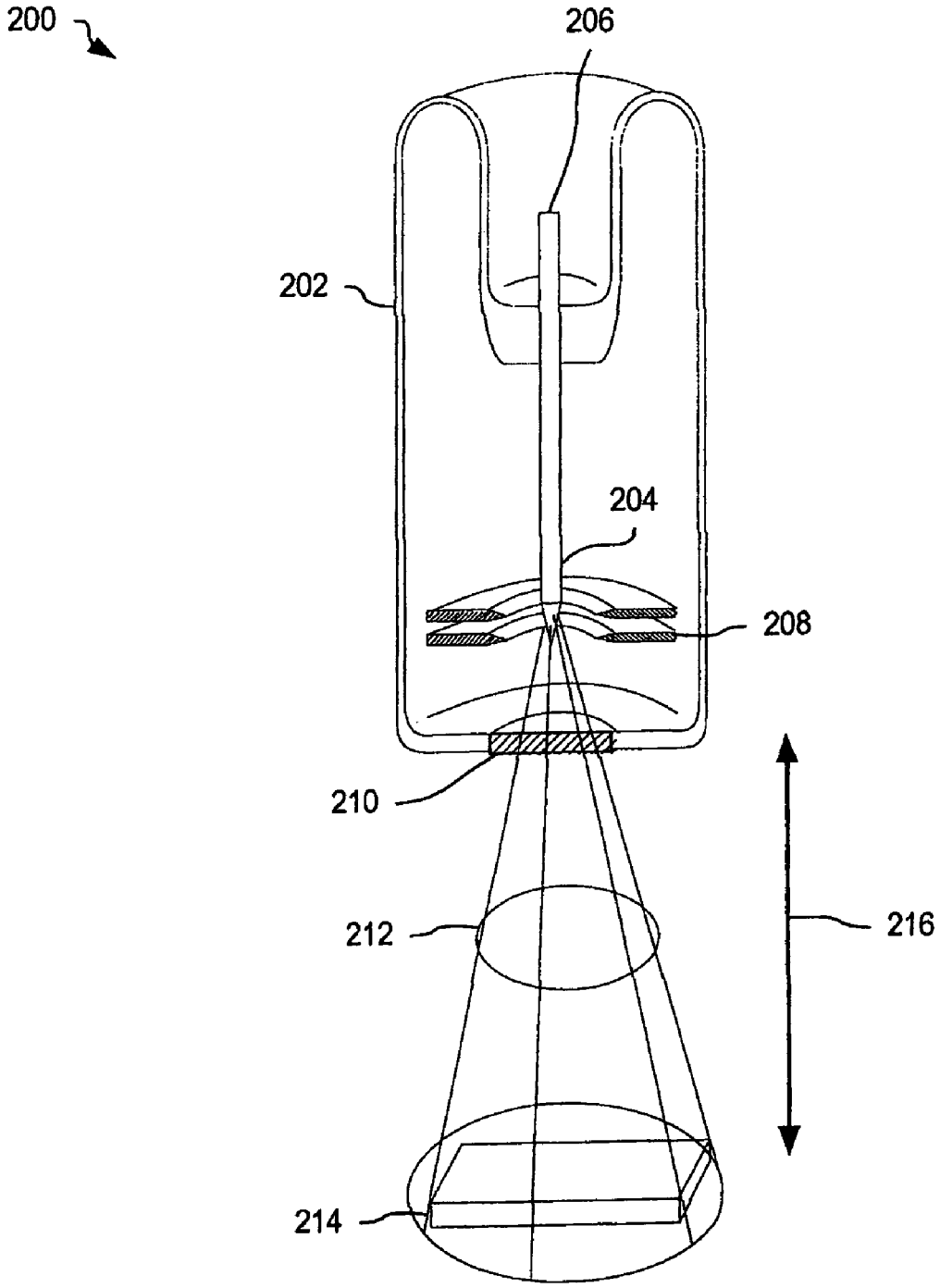
FIG. 2 PRIOR ART
FIG. 2 shows one prior art field electron emission reflective geometry X-ray source.

FIG. 2 shows an alternative prior-art, field emission, reflective geometry, small originating spot, X-ray source 200. X-ray source 200 has an evacuated enclosure 202 with a cathode 208, an anode target 204 and an X-ray tube window 210. A high potential difference is applied between cathode 208 and anode target 204. The high electric field created between the non-heated, sharp edged, cathode 208 and anode target 204, results in, electron emission from cathode 208. These field emitted electrons are accelerated by the high electric field, towards anode target 204. These electrons impact a conical shaped, heavy metal (high atomic number) target tip of anode target 204 and generate a reflected X-ray beam 212. X-ray beam 212 exits evacuated enclosure 202 through X-ray tube window 210. Anode target 204 produces a small spot source of X-rays resulting in a diverging X-ray beam 212, as shown. The geometry of X-ray beam 212 in similar to that of X-ray beam 114 of FIG. 1. The required distance to achieve a sufficient spread of X-ray beam 212 to cover a material 214 to be irradiated results in a large distance 216 from X-ray source 200 to material 214, and thus having all the disadvantages relating to this distance as discussed for X-ray source 100.

The point sources of the anodes in the prior art examples of FIGS. 1 and 2 result in small originating point, conical shaped, X-ray beams. To overcome this limitation, a solution for which has not yet been considered in view of the prior art designs, it would be beneficial to develop a cathode with a large, field electron emitting surface, such that electrons are emitted in the form of a beam with a large cross section, which then impacts a similarly sized target foil to generate an X-ray beam with substantially parallel lines of energy. Both the spatial distribution of beam intensity and the intensity-energy of such a generated X-ray beam are more homogeneous than the prior-art X-ray beams 114 and 212 of X-ray sources 100 and 200, respectively.

Figure 3:
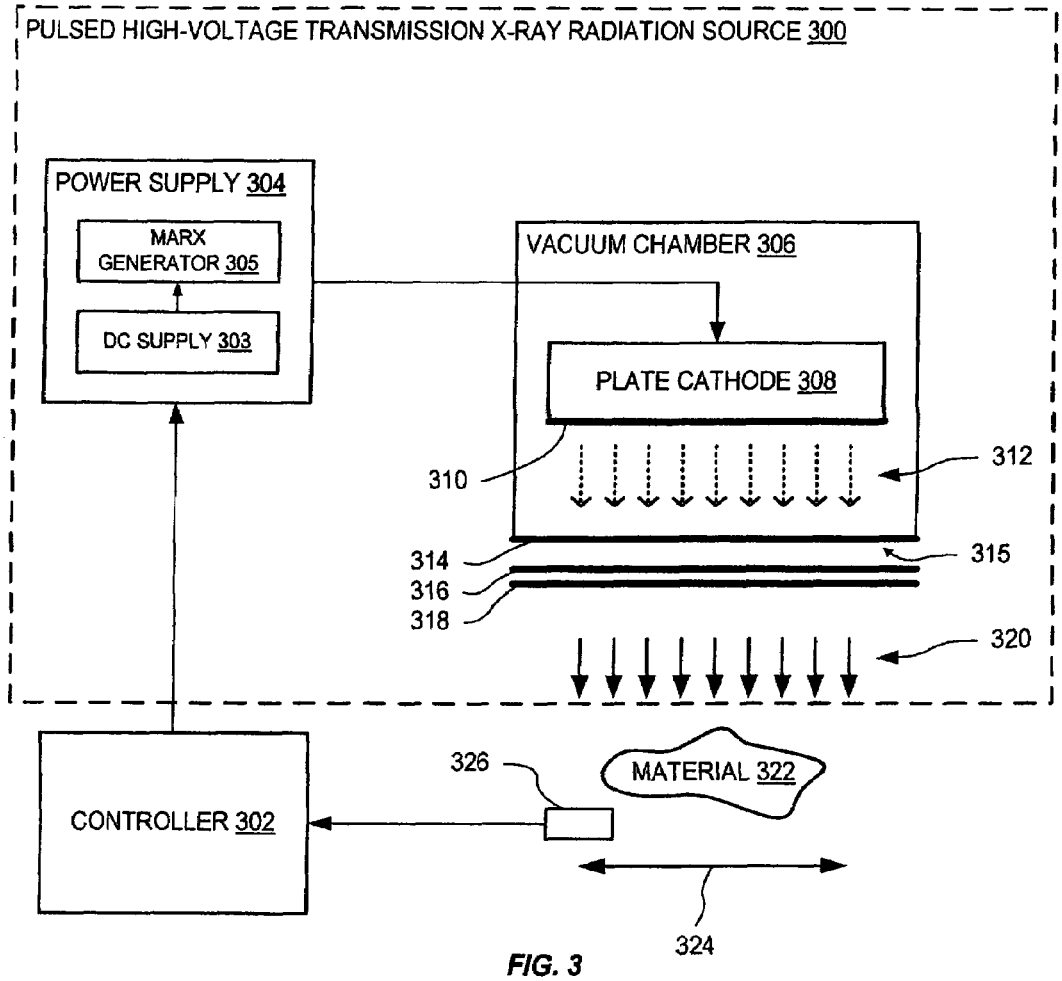
FIG. 3 shows one exemplary pulsed high-voltage transmission X-ray radiation source, in an embodiment.
Figure 4:
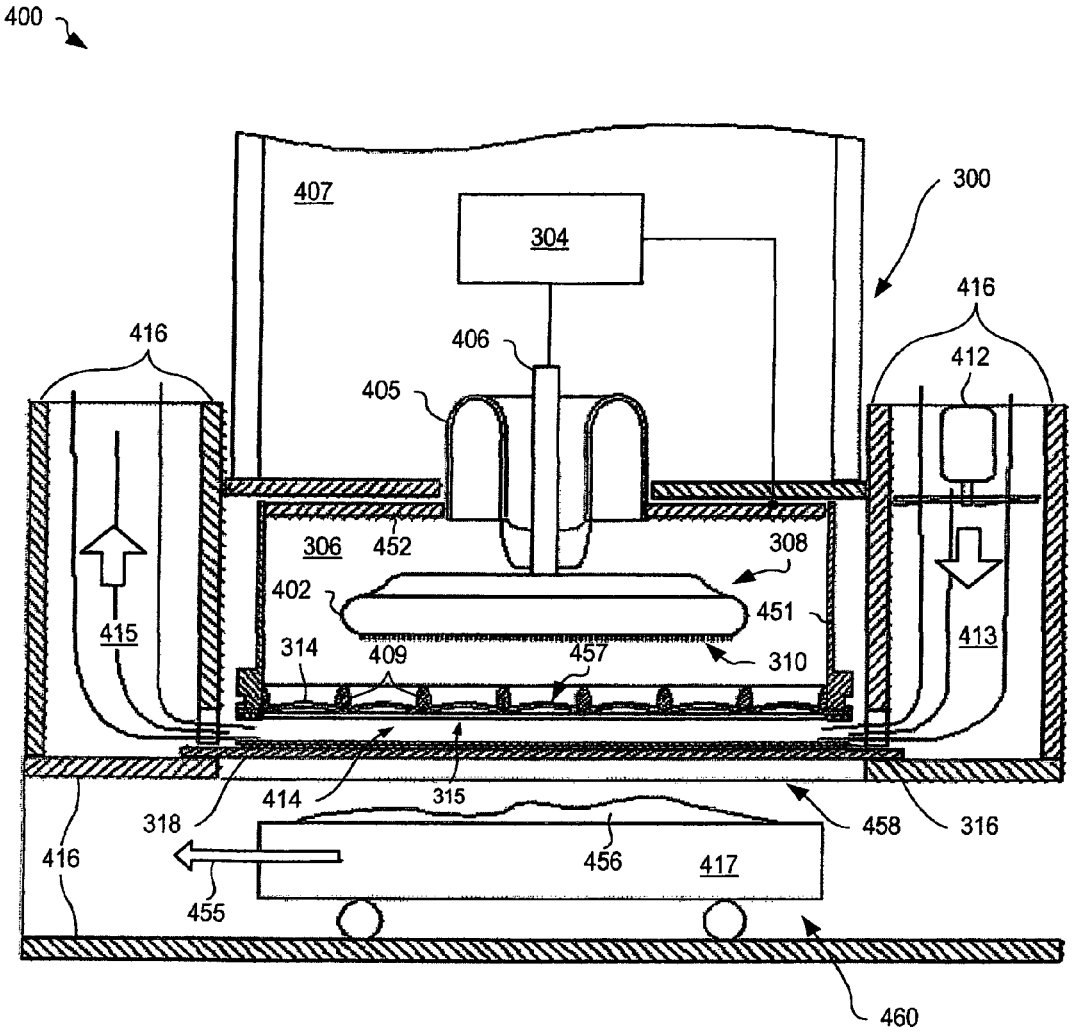
FIG. 4 shows one exemplary X-ray irradiation system for irradiating material prior to transfusion/transplant using the pulsed high-voltage transmission X-ray radiation source of FIG. 3.

Most of the disadvantages of small originating spot, "reflective geometry" X-ray production, as shown in FIGS. 1 and 2, are overcome when using field electron emission "transmission geometry", as shown in FIGS. 3 and 4.

FIG. 3 is a block diagram illustrating one exemplary pulsed high-voltage transmission X-ray radiation system 300. A plate cathode 308, having a large area, field electron, emissive surface 310, is located within a vacuum chamber 306. A power supply 304 includes a Marx generator 305 for generating negative high voltage pulses (e.g., in the range −200 kV to −1,000 kV that are applied to plate cathode 308. Surface 310 of cathode 308 emits a large beam of electrons 312 that are accelerated towards a thin foil 314, which forms an electron window 315 of vacuum chamber 306. High energy electrons 312 pass through thin foil 314 to impact a heavy metal target foil 316, causing X-ray generation. Heavy metal target foil 316 may be made of one or more of molybdenum, tantalum, tungsten, rhenium, osmium, iridium, platinum and gold. An aluminum plate 318, attached to (e.g., using a bonding technique to provide good thermal contact), foil 316, acts as a filter to remove lower energy X-rays while allowing a high energy X-ray beam 320 to pass through. A copper plate may be used in place of aluminum plate 318 to filter lower energy X-rays without departing from the scope hereof. X-ray beam 320 contains substantially parallel lines of X-ray energy with a cross-sectional area approximately equal to the area of field electron emissive surface 310.

While the target foil 316 and filter plate 318 are shown outside the vacuum chamber in FIG. 3, the target foil 316 and the filter plate 318, in an alternate embodiment of the system 300, can be placed inside the chamber 306 and parallel to the cathode 308 for receiving the beam of electrons thereon. In this example, the target foil 316 would generate the X-ray beam 320 inside the vacuum chamber and pass the X-ray barn through the filter 318, thereby filtering out the lower energy X-ray beams and passing the higher energy X-ray beams through the electron window 315 and onto the material to be irradiated.

In the example of FIG. 3, pulsed high-voltage transmission X-ray radiation system 300 is shown irradiating a material 322. X-ray beam 320 is shown with a width 324 equal or greater than the width of material 322. Thus, material 322 of equal or less area is irradiated while stationary within X-ray beam 320.

A controller 302 receives feedback from a solid-state X-ray radiation sensor 326 that measures the total, absorbed radiation density received by material 322 and controls operation of power supply 304 to generate X-ray beam 320 such that the required dose of X-rays is received by material 322. Controller 302 may receive input from other sensors and input from one or more users without departing from the scope hereof.

The shape and size of the cross-sectional area of field electron emissive surface 310 may be selected to form a desired shape and size of the cross-sectional area of X-ray beam 320. For example, a rectangular field electron emissive surface 310 is used to generate a rectangular cross-sectional shaped X-ray beam 320, a circular field electron emissive surface 310 is used to generate a circular cross-sectional shaped X-ray beam 320, a square field electron emissive surface 310 is used to generate a square cross-sectional shaped X-ray beam 320, an oval field electron emissive surface 310 is used to generate an oval cross-sectional shaped X-ray beam 320, and so on.

Power supply 304 includes a DC supply 303 for charging Marx generator 305. Marx generator circuits (e.g., Marx generator 305) are well known in the power supply art, and will therefore not be described in detail herein. In summary, Marx generator 305 multiplies an input DC voltage (e.g., supplied by DC supply 303) to generate a negative high voltage output pulse under control of controller 302; controller 302 may control one or both of DC supply 303 and Marx generator 305. For certain applications of system 300, pulse width, pulse frequency and magnitude of the negative, pulsed, high voltage applied to cathode 308 (and thus electron emitter surface 310) may be pre-set and fixed thereby requiring no interaction by an operator. For example, FDA requirements specify an absorbed radiation dose for each bag of blood. This dose is a fixed quantity and power supply 304 may be pre-configured to deliver the required dose.

FIG. 4 shows a cross section through one exemplary pulsed high-voltage transmission X-ray irradiation system 400 for irradiating a material 456. System 400 utilizes pulsed high-voltage transmission X-ray radiation system 300, FIG. 3, to generate substantially parallel X-ray radiation energy. System 400 consists of vacuum chamber 306 that is formed with chamber walls 451, a top plate 452 and foil 314 at the bottom. Top plate 452 has a centrally mounted high voltage electrical insulator 405 that provides a vacuum seal with top plate 452.

Chamber walls 451 and top plate 452 are for example made from one or more of stainless steel, aluminum and titanium. High voltage electrical insulator 405 is for example made from ceramic and/or glass. Vacuum chamber 306 houses a cathode 308. Cathode 308 is formed of a plate 402 with field electron emitting surface 310. Cathode 308 is held in place by a high voltage connector 406 that passes through high voltage electrical insulator 405. Field electron emitting surface 310 may be formed of (a) a mesh of submicron sized elements made of carbonated fabric, and/or (b) wire-brush like structures consisting of multiple pins and/or needles made from conducting or semi-conducting materials such as tungsten, molybdenum, titanium, stainless steel, oxidized aluminum and carbon nanotubes, in combination with insulating materials. Field electron emitting surface 310 may also be formed as a fine metal grid. Electron emitting surface 310 may also be formed by rough etching a lower surface of plate 402. In one example, electron emitting surface 310 is attached to plate 402 by ribs. In another example, electron emitting surface 310 is attached to plate 402 at several points using electro-welding, plating or other mechanical means such as screws and ribs.

Electron emitting surface 310 is positioned a short distance (e.g., between 0.5 cm to 3 cm) from light metal foil 314 of vacuum chamber 306. A negative output of high-voltage pulsed power supply 304, shown within a chamber 407 near vacuum chamber 306, connects to cathode 308 via high voltage connector 406. Power supply 304 is preferably located within chamber 407 but may be located elsewhere, such as external to chamber 407, without departing from the scope hereof High voltage power supply 304 generates negative high-voltage pulses with pulse widths between 50 nanoseconds and 1 millisecond, and preferably between 100-500 nanoseconds, at a frequency between 0.1 Hz and 400 Hz, and preferably at a frequency between 5 and 10 Hz.

Foil 314, forming electron window 315, is supported by equally spaced ribs 409. Rib spacing is based upon both thickness of foil 314 and cross section of ribs 409. In a preferred embodiment, ribs 409 are stainless steel with a cross section of 2×5 mm and a spacing of 2 cm, and foil 314 is titanium with a thickness of 2 mils (50 μm). Foil 314 is sealed with respect to chamber walls 451 thereby preserving the vacuum within chamber 306. Foil 314 is for example a thin light metal (i.e., having a low atomic number) such as titanium, titanium alloys, vanadium, chromium, cobalt, stainless steel and nickel with a thickness of 2 mils (50 μm).

Foil 314 and supporting ribs 409 operate as an anode 457 for cathode 308 and form a transmission window for electrons emitted by field electron emitting surface 310. In one example, vacuum chamber 306 is grounded, thereby maintaining anode 457 at ground potential.

X-ray emitter target foil 316 is positioned external to, at a short distance (e.g., between 5 mm and 30 mm) from, and parallel with, foil 314 of chamber 306. As high velocity electrons strike target foil 316, X-ray radiation is generated. Target foil 316 is attached (e.g., bonded for good thermal contact) to a thin (e.g., between 0.2 mm and 4 mm) aluminum (or copper) plate 318. Aluminum plate 318 is attached to the side of target foil 316 from which X-ray radiation emanates and removes (i.e., filters) the non-useful, low energy part of the X-ray spectrum emitted from target foil 316. Thus, only the desired X-ray spectrum passes through an opening 458 beneath target foil 316 and aluminum plate 318 to reach material 456.

A fan 412 is located in an air inflow channel 413 and operates to force air through a passageway 414, between foil 314 and target foil 316, and then out of an air outflow channel 415. Fan 412 thereby provides cooling to target foil 316. Aluminum (or copper) plate 318 also dissipates heat generated in target foil 316.

Appropriate thickness of shielding 416 and the shapes of chamber 306, inflow channel 413, outflow channel 415, and irradiation chamber 460 ensure safe operation of system 400. Shielding 416 is for example lead, although other radiation blocking material may be used without departing from the scope hereof.

In the example of FIG. 4, a transport vehicle 417 operates to move (as indicated by arrow 455) material 456 (e.g., a bag of blood) through irradiation chamber 460 to irradiate the blood.

In one example of operation, a negative high voltage pulse, with respect to ground potential of anode 457, is generated by power supply 304 and applied to cathode 308. This high voltage pulse generates an electric field between electron emitting surface 310 and foil 314 resulting in the emission of electrons 312 (see FIG. 3) from electron emitting surface 310 and their acceleration towards foil 314. These accelerated electrons pass through foil 314 and passage 414 to impact target foil 316 whereupon they are decelerated and produce a spectrum of X-ray radiation that is directed towards irradiation chamber 460. Aluminum plate 318 filters the X-ray radiation to remove the non-useful, lower energy part of the X-ray spectrum such that the X-ray beam (e.g., X-ray beam 320) entering irradiation chamber 460 is of high-energy and therefore useful. The X-ray beam entering irradiation chamber 460 is controlled such that a predetermined radiation dose is applied to the contents of transport vehicle 417.

Each high voltage pulse produces a certain amount of X-ray radiation to provide a required, total absorbed dose of X-ray radiation to irradiate the contents of transport vehicle 417. More than one pulse of X-ray radiation may be required to achieve the desired total absorbed dose. The frequency and duration of these high voltages pulses applied to cathode 308 determines the amount of X-ray radiation generated to achieve a total absorbed radiation dose by the contents of transport vehicle 417.

Figure 5:
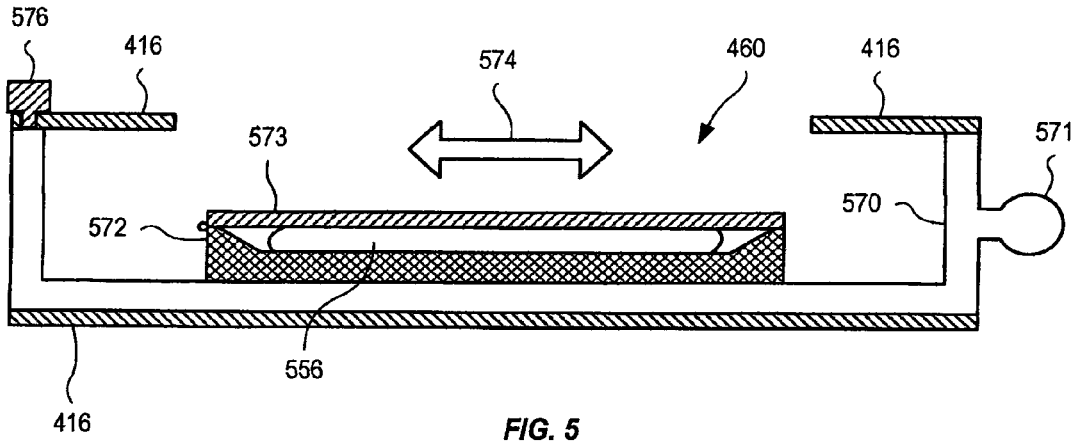
FIG. 5 shows one exemplary material container and positioning device for use with the system of FIG. 4.

Alternative methods for positioning material to be irradiated within irradiation chamber 460 may be used without departing from the scope hereof. For example, as shown in FIG. 5, a drawer 570 is constructed to slide (as shown by arrow 574) in and out of irradiation chamber 460. A material container 572 is positioned within draw 570 such that when drawer 570 is closed, for example by an operator using handle 571, material 556 (e.g., one or more bags of blood) deposited within container 572 is positioned beneath opening 458 to receive a controlled irradiation dose during operation of system 400. Irradiation chamber 460 may include one or more sensors 576 to determine when drawer 570 is closed to prevent improper operation of system 400.

Where the material being irradiated is contained within a bag, such as a blood bag, material container 572 preferably includes a lid 573 that is transparent to X-ray radiation and functions to compress the blood bag to have a uniform depth for irradiation.

Figure 6:
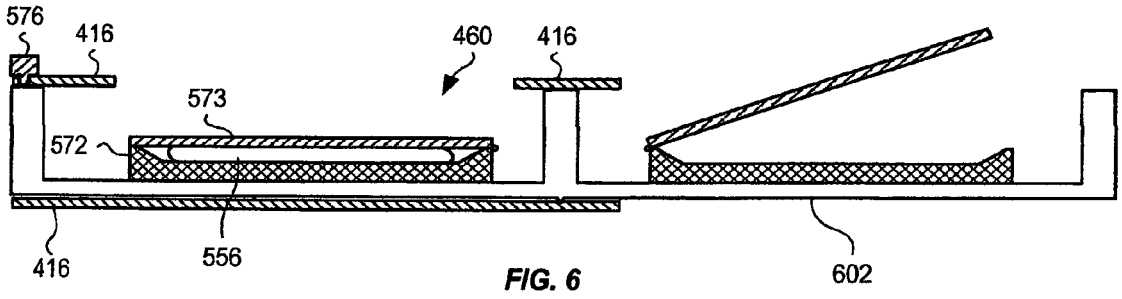
FIG. 6 shows a turntable that automatically rotates to position material for irradiation within the system of FIG. 4, in an embodiment.

In an alternate embodiment, shown in FIG. 6, material for irradiation is positioned beneath opening 458 by a turntable 602 that automatically rotates to position the material beneath opening 458 for irradiation during each irradiation cycle.

Figure 7:
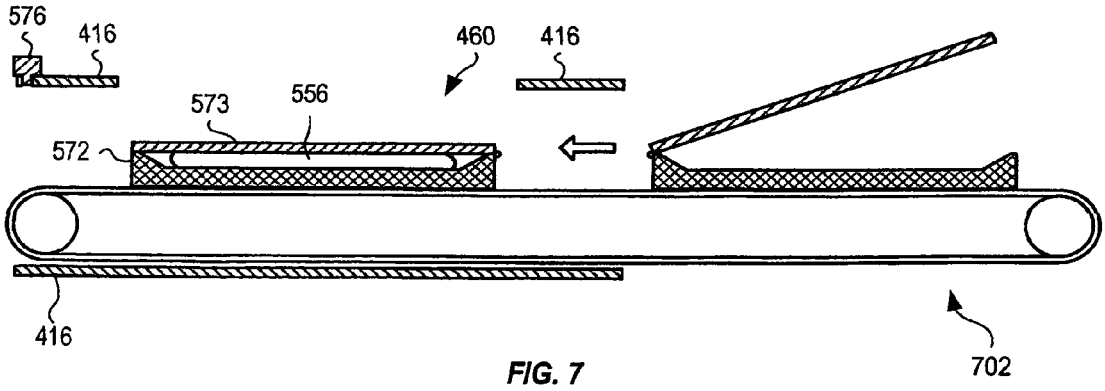
FIG. 7 shows a conveyor belt traveling at a constant speed to irradiate material using the system of FIG. 4, in an embodiment.

In yet another embodiment, shown in FIG. 7, a conveyor belt 702 travels at a constant speed beneath opening 458 such that material to be irradiated (e.g., bags of blood) may be placed upon the conveyor belt to pass beneath opening 458 to receive radiation from X-ray system 300.

The size of field electron emitting surface 310, and associated size of foil target 316, is selected to provide X-ray beam 320 with a cross-sectional area that is sufficient to cover the material to be irradiated (e.g., a blood bag). Thus, the material receiving the irradiation may remain stationery within irradiation chamber 460 while being irradiated.

By combining a cathode with a large field electron emitting surface and a correspondingly large area target foil, a substantially parallel X-ray beam with a large cross-sectional area is generated. Cathode 308, with large field electron emitting surface 310, emits a large electron beam 312 towards target foil 316 which in turn emits a correspondingly sized, forward directed, X-ray beam 320 that is uniform in both energy and intensity, and has a spatial distribution of beam intensity and intensity-energy that is much more homogeneous than from prior-art X-ray sources.

The use of a pulsed, high voltage power supply 304 (e.g., including a Marx Generator) eliminates the disadvantages of the constant potential, high voltage power supply typically used with prior-art X-ray generation. Pulsed high voltage power supply 304 (a) may be operated at higher voltage (e.g., −200 kV to −1000 kV) as compared to 80 kV-200 kV for a prior art X-ray source; (b) may require significantly less power (e.g., 0.5 kW-3.0 kW) as compared to 5.0-10 kW for the prior-art X-ray source; (c) does not require initial warm-up (i.e., a time period during which voltage and current are gradually increased to operating levels for the prior-art X-ray source); (d) does not produce unaccounted for radiation resulting from an interruption of input power during warm-up of a constant potential high voltage power supply; (e) has fewer challenges with high voltage isolation; and (f) is less complex in design and construction than a conventional power supply for a prior-art X-ray source and therefore costs less.

Further, the distance between the X-ray source and the material 322 to be irradiated is not dependent upon X-ray beam divergence, since X-ray beam 320 is composed of substantially parallel lines of X-ray energy with a cross sectional area approximately equal to the area of field electron emitting surface 310. Thus, material 322 may be located a short distance from opening 458 of irradiation chamber 460 and still receive uniform irradiation.

Figure 8:
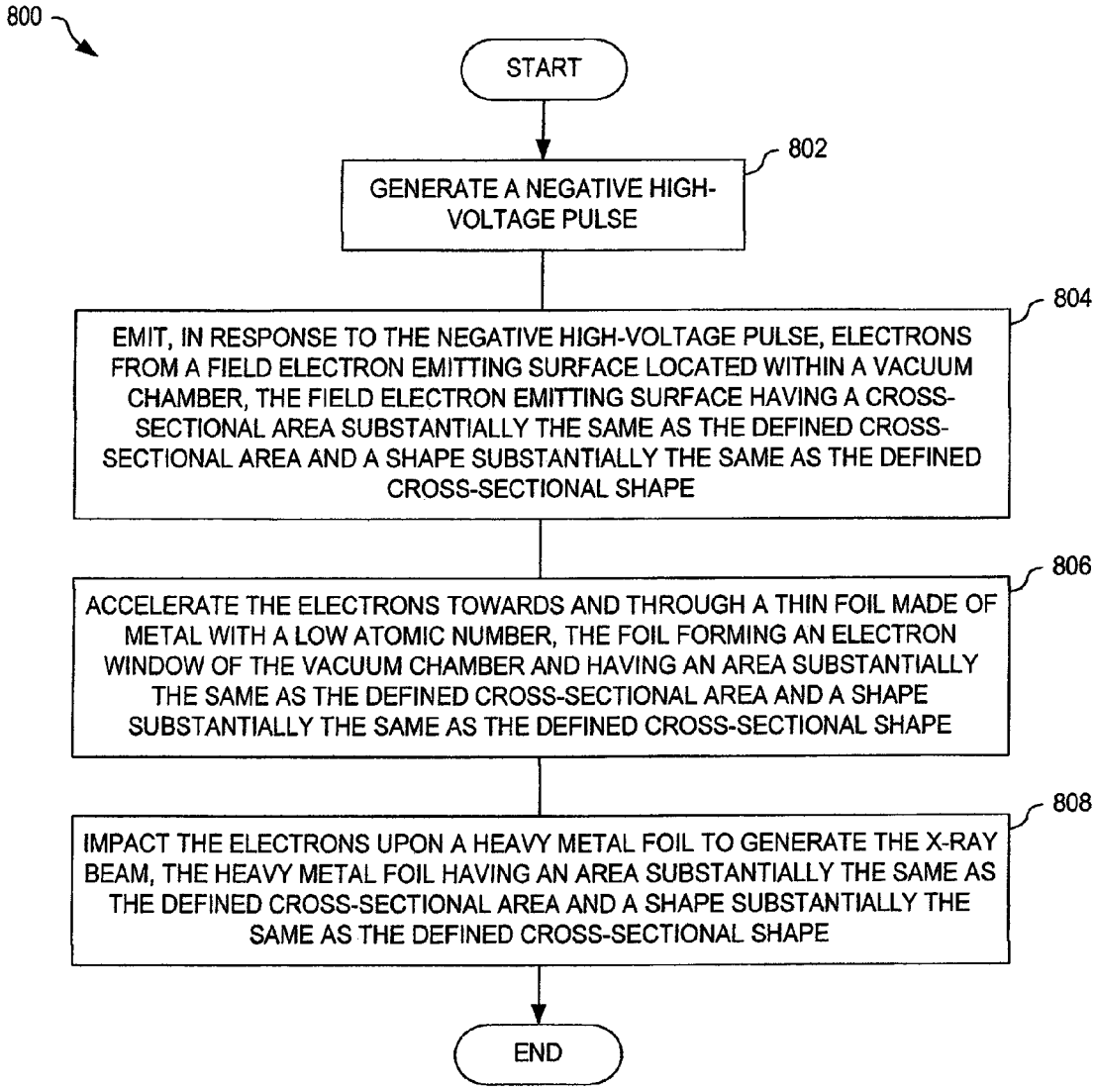
FIG. 8 is a flowchart illustrating one exemplary method for generating an X-ray beam with a defined cross-sectional area and a defined cross-sectional shape.

FIG. 8 is a flowchart illustrating one exemplary method 800 for generating an X-ray beam with a defined cross-sectional area and a defined cross-sectional shape. In step 802, method 800 generates a negative high-voltage pulse. In one example of step 802, power supply 304 includes a Marx generator 305 that generates a high-voltage negative pulse. In step 804, method 800 emits, in response to the negative high-voltage pulse, electrons from a field electron emitting surface located within a vacuum chamber, the field electron emitting surface having an area substantially the same as the defined cross-sectional area and a shape substantially the same as the defined cross-sectional shape. In one example of step 804, field electron emitting surface 310 within vacuum chamber 306 emits electron beam 312 in response to the negative high-voltage pulse, from power supply 304, applied to plate cathode 308. In step 806, method 800 accelerates the electrons towards and through a thin foil made of metal with a low atomic number, the foil forming an electron window of the vacuum chamber and having an area substantially the same as the defined cross-sectional area and a shape substantially the same as the defined cross-sectional shape. In one example of step 806, electron beam 312 is accelerated towards and though thin foil 314, which is made of titanium. In step 808, method 800 impacts the electrons upon a heavy metal foil having an area substantially the same as the defined cross-sectional area and a shape substantially the same as the defined cross-sectional shape to generate the X-ray beam. In one example of step 808, electron beam 312 impacts heavy metal target foil 316 to generate X-ray beam 320.

Figure 9:
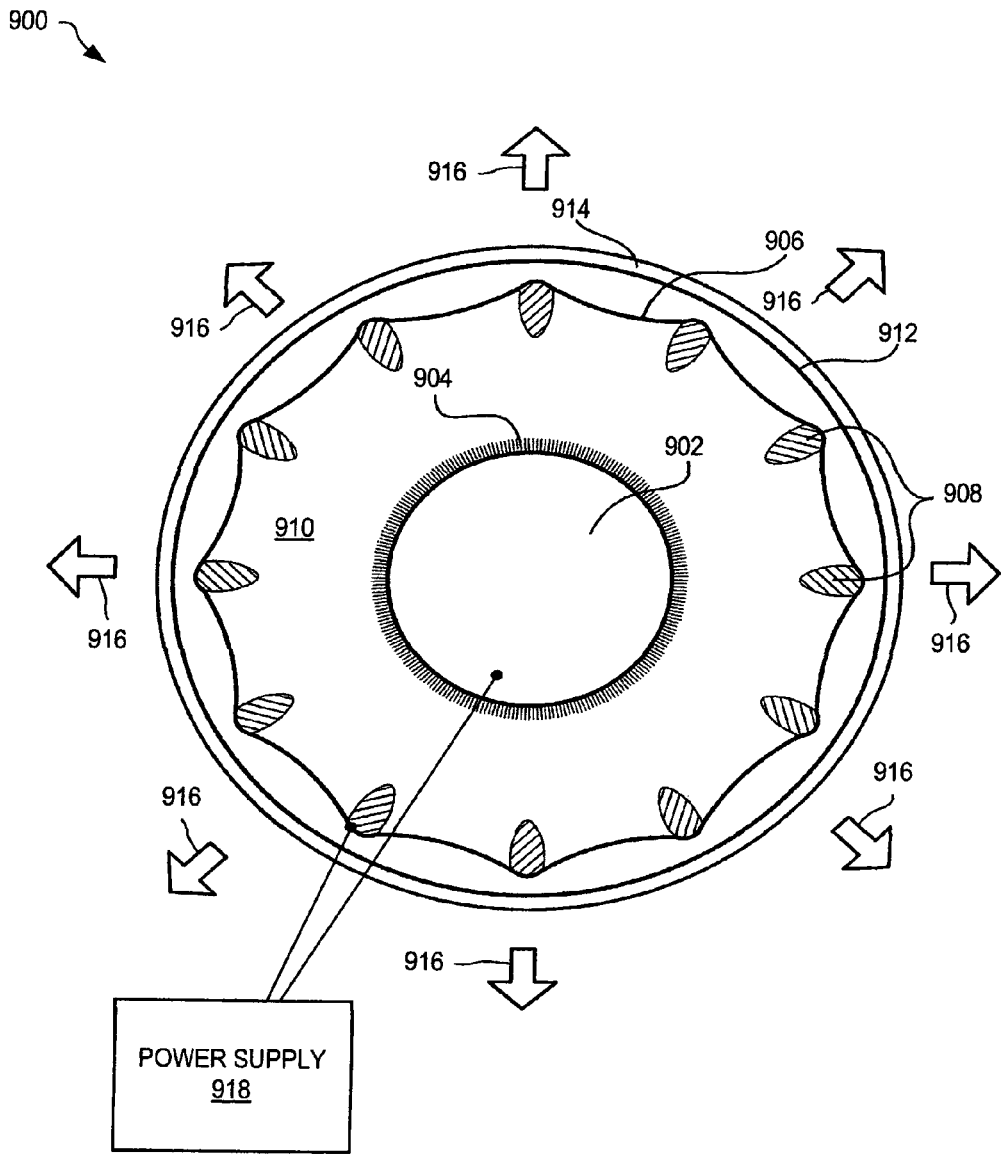
FIG. 9 shows a cross-section through one exemplary pulsed high-voltage transmission X-ray radiation source having a cylindrical form, in an embodiment.

FIG. 9 shows a cross-section through one exemplary pulsed high-voltage transmission X-ray radiation source 900 having a cylindrical form. Radiation source 900 has a cylindrical large area cathode 902 that may be solid or hollow. An exterior surface of cathode 902 is coated with a field electron emissive surface 904, which may be made of similar materials to surface 310 of radiation system 300, FIG. 3. A thin metallic foil 906 is supported by ribs 908 around cathode 902 and emissive surface 904 and forms a vacuum chamber 910 (ends of the cylindrical shape formed by thin metal foil 906 and cathode 902 are sealed). Thin metallic foil 906 may be made of similar materials as foil 314. Ribs 908 may be made of a material similar to ribs 409 of FIG. 4. Foil 906 is surrounded by a cylinder 914 formed of aluminum or copper that has an internal coating 912 of heavy metal. Coating 912 may also be formed as a separate cylinder without departing from the scope hereof. Coating 912 functions similarly to heavy metal foil 316 to generate X-ray radiation upon electron impact. Cylinder 914 functions similarly to aluminum plate 318 to filter weaker X-ray radiation.

In one example of operation, a high-voltage pulse, having a negative polarity with respect to thin foil 906, is generated by a power supply 918 and applied to cathode 902 such that emissive surface 904 emits electrons. These electrons are accelerated towards, and through, thin metal foil 906 to impact upon coating 912 and generate X-ray radiation. Cylinder 914 filters weaker X-ray energy, and radial X-ray energy 916 is emitted from X-ray radiation source 900. Power supply 918 may be similar to power supply 304 and include a Marx generator, for example. Thus, operation of X-ray source 900 is substantially similar to operation of X-ray system 300.

X-ray radiation source 900 may be formed as other shapes to generate alternative X-ray radiation patterns without departing from the scope hereof. For example, X-ray radiation source 900 may be shaped as one or more of a cube, a sphere, a cone, a prism, a polyhedron, and a pyramid.

While the invention has been particularly shown, described and illustrated in detail with reference to the preferred embodiments and modifications thereof, it should be understood by those skilled in the art that equivalent changes in form and detail may be made therein without departing from the true spirit and scope of the invention as claimed except as precluded by the prior art.

The embodiments of the invention for which an exclusive privilege and property right is claimed are defined as follows:

1. A system for irradiating material used in transfusions, the material can be pre-transfused blood, blood components and marrow, the system comprising:

a vacuum chamber;

a cathode disposed inside the vacuum chamber, the cathode having a large beam electrode emissive surface, the emission surface having a selected cross-sectional shaped area;

a power supply connected to the cathode for generating negative high-voltage pulses thereto, whereby the negative high-voltage pulses causing a selected cross-sectional shaped beam of electrons to be emitted from the selected cross-sectional shaped area of the emissive surface of the cathode;

an electron window disposed inside the vacuum chamber, the electron window made of thin metal foil, the thin metal foil having a low atomic number, the electron window for receiving the selected cross-sectional shaped beam of electrons therethrough;

an electron target disposed outside the vacuum chamber, the electron target positioned substantially parallel to the electron window and in a spaced relationship thereto, the electron target receiving the selected cross-sectional shaped beam of electrons thereon and generating a selected cross-sectional shaped X-ray beam; and an X-ray beam filter in contact with and disposed next to the electron target and parallel thereto, the filter spaced apart from the material to be irradiated by the X-ray beam, the filter eliminating low energy beams from the spectrum of the X-ray beam when the X-ray beam is received therethrough, the filtered X-ray beam exposing the material to high energy beams from the spectrum of the X-ray beam.

2. The system as described in claim 1 further including a radiation sensor disposed next to the material to be irradiated, the radiation sensor connected to a radiation controller, the radiation controlled connected to the power supply, the radiation sensor measuring a total absorbed radiation dose by the material from the X-ray beam.

3. The system as described in claim 1 wherein the emissive surface of the cathode has an annular cross-sectional area for generating an annular cross-sectional shaped beam of electrons.

4. The system as described in claim 1 wherein the emissive surface of the cathode has an angular cross-sectional shaped area for generating an angular cross-sectional shaped beam of electrons.

5. The system as described in claim 1 wherein the width of the beam of electrons and the width of the X-ray beam is at least as wide as the width of the material to be irradiated.

6. The system as described in claim 1 wherein the width of the beam of electrons is equal to the width of the X-ray beam.

7. The system as described in claim 1 wherein the power supply is a Marx generator, or Tesla transformer generator, the generator generating negative pulses with respect to the window, between −1000 kV and −200 kV at a frequency between 0.1 Hz and 400 Hz.

8. The system as described in claim 1 wherein the metal foil electron window is made of titanium, titanium alloy, vanadium, chromium, cobalt, stainless steel or nickel, the metal foil electron target is made of molybdenum, tantalum, tungsten, rhenium, osmium, iridium, platinum or gold and the cathode filter is made of aluminum, copper, or zinc.

9. A system for irradiating material used in transfusions, the material can be pre-transfused blood, blood components and marrow, the system comprising:

a vacuum chamber;

a cathode disposed inside the vacuum chamber, the cathode having a large beam electrode emissive surface, the emission surface having a selected cross-sectional shaped area;

a high-voltage generator connected to the cathode for generating negative high-voltage pulses thereto and having pulse widths between 50 nanoseconds and 1 millisecond, whereby the negative high-voltage pulses causing a selected cross-sectional shaped beam of electrons to be emitted from the selected cross-sectional shaped area of the emissive surface of the cathode;

an electron window disposed inside the vacuum chamber, the electron window made of thin metal foil, the thin metal foil having a low atomic number, the electron window for receiving the selected cross-sectional shaped beam of electrons therethrough;

an electron target disposed outside the vacuum chamber, the electron target positioned substantially parallel to the electron window and spaced apart in a range of 5 to 30 mm, the electron target receiving the selected cross-sectional shaped beam of electrons thereon and generating a selected cross-sectional shaped X-ray beam; and an X-ray beam filter disposed next to the electron target and parallel thereto, the filter spaced apart from the material to be irradiated by the X-ray beam, the filter eliminating low energy beams from the spectrum of the X-ray beam when the X-ray beam is received therethrough, the filtered X-ray beam exposing the material to high energy beams from the spectrum of the X-ray beam.

10. The system as described in claim 9 further including a radiation sensor disposed next to the material to be irradiated, the radiation sensor connected to a radiation controller, the radiation controlled connected to the power supply, the radiation sensor measuring a total absorbed radiation dose by the material from the X-ray beam.

11. The system as described in claim 9 wherein the emissive surface of the cathode has an annular cross-sectional shaped area for generating an annular cross-sectional shaped beam of electrons.

12. The system as described in claim 9 wherein the emissive surface of the cathode has an angular cross-sectional area for generating an angular cross-sectional shaped X-ray beam.

13. The system as described in claim 9 wherein the width of the beam of electrons and the width of the X-ray beam is at least as wide as the width of the material to be irradiated.

14. The system as described in claim 9 wherein the width of the beam of electrons is equal to the width of the X-ray beam.

15. The system as described in claim 1 wherein the generator is a Marx generator, the generator generating negative pulses between −1000 kV and −200 kV at a frequency between 0.1 Hz and 400 Hz.

16. A system for irradiating material used in transfusions, the material can be pre-transfused blood, blood components and marrow, the system comprising:

a vacuum chamber;

a plate cathode disposed inside the vacuum chamber, the cathode having a large beam electrode emissive surface, the emission surface having a selected cross-sectional shaped area;

a power supply connected to the cathode for generating negative high-voltage pulses thereto, whereby the negative high-voltage pulses causing a selected cross-sectional shaped beam of electrons to be emitted from the selected cross-sectional shaped area of the emissive surface of the cathode;

an electron target disposed inside the vacuum chamber, the electron target receiving the selected cross-sectional shaped beam of electrons thereon and generating a selected cross-sectional shaped X-ray beam;

an X-ray beam filter bonded to and disposed next to the electron target, the filter eliminating low energy beams from the spectrum of the X-ray beam when the X-ray beam is received therethrough, the filtered X-ray beam exposing the material to high energy beams from the spectrum of the X-ray beam;

an electron window disposed inside the vacuum chamber and spaced apart from the filter and parallel thereto, the electron window made of thin metal foil, the thin metal foil having a low atomic number, the electron window for receiving the filtered X-ray beam therethrough and exposing the material to be irradiated by the X-ray beam.

17. The system as described in claim 16 further including a radiation sensor disposed next to the material to be irradiated, the radiation sensor connected to a radiation controller, the radiation controlled connected to the power supply, the radiation sensor measuring a total absorbed radiation dose by the material from the X-ray beam.

18. The system as described in claim 16 wherein the emissive surface has an annular cross-sectional area for generating an annular cross-sectional shaped beam of electrons.

19. The system as described in claim 16 wherein the emissive surface of the cathode has an angular cross-sectional area for generating an angular cross-sectional shaped beam of electrons.

20. The system as described in claim 16 wherein the width of the beam of electrons and the width of the X-ray beam is at least as wide as the width of the material to be irradiated and the width of the beam of electrons is equal to the width of the X-ray beam.

* * * * *